US005143373A

United States Patent [19]

Meissner

[11] Patent Number: 5,143,373

[45] Date of Patent: Sep. 1, 1992

[54] TENNIS RACKET

[76] Inventor: Juergen Meissner, 551 Rte. 10, Randolph, N.J. 07869

[21] Appl. No.: 552,335

[22] Filed: Jul. 12, 1990

Related U.S. Application Data

[62] Division of Ser. No. 218,830, Jul. 13, 1988, abandoned.

[51] Int. Cl.[5] ..... A63B 69/38

[52] U.S. Cl. ..... 273/73 R; 273/73 J; 273/73 G; 273/75; 273/193 B; 273/81.3

[58] Field of Search ..... 273/29 R, 29 A, 193 B, 273/73 R, 73 F, 73 J, 75, 81.2, 81.3, 81 R

[56] References Cited

U.S. PATENT DOCUMENTS

| | | | |
|---|---|---|---|
| 881,266 | 3/1908 | Thompson | 273/73 J |
| 2,159,579 | 5/1939 | Whitney | 273/193 B |
| 2,183,925 | 12/1939 | Simpson | 273/73 G |
| 3,679,205 | 7/1972 | Finkle et al. | 273/186 A |
| 4,101,132 | 7/1978 | Conrey et al. | 273/29 A |
| 4,221,383 | 9/1980 | Cappelli | 273/73 R |
| 4,367,871 | 1/1983 | Schiefer | 273/73 J |
| 4,655,449 | 4/1987 | Chamness | 273/73 J |
| 4,736,949 | 4/1988 | Muroi | 273/73 J |
| 4,852,875 | 8/1989 | McLennan et al. | 273/29 A |
| 4,870,868 | 10/1989 | Gastgeb et al. | 273/29 A |
| 4,907,810 | 3/1990 | Whiteford | 273/75 |
| 4,911,441 | 3/1990 | Brunner | 273/29 A |

FOREIGN PATENT DOCUMENTS

| | | | |
|---|---|---|---|
| 0358856 | 9/1922 | Fed. Rep. of Germany | 273/73 R |
| 3139006 | 4/1983 | Fed. Rep. of Germany | 273/73 J |
| 3428528 | 2/1986 | Fed. Rep. of Germany | 273/73 J |
| 823727 | 10/1937 | France | 273/73 J |
| 828452 | 2/1938 | France | 273/73 J |
| 2493710 | 5/1982 | France | 273/73 J |
| 0015670 | of 1886 | United Kingdom | 273/73 G |
| 11067 | of 1912 | United Kingdom | 273/73 R |
| 0001819 | of 1915 | United Kingdom | 273/73 G |

OTHER PUBLICATIONS

Stites, Pamela, "Health Line-Bone of Contention", *World Tennis*, Feb. 1988.

*Primary Examiner*—William H. Grieb
*Assistant Examiner*—Jessica J. Harrison
*Attorney, Agent, or Firm*—Richard M. Goldberg

[57] ABSTRACT

Tennis racket has a head with a face lying in a facial plane. The racket has a shaft fixed to and coplanar with the head. The racket also has a handle sized for grasping the racket during play. Also included is a flexible device located at least partly within the handle and flexibly coupling the handle with the shaft. The head is relatively displaceable along a direction remaining perpendicular to the facial plane and coplanar with the handle. Thus an incorrect swing of the racket causes flexing at the handle and a manual sensation.

26 Claims, 2 Drawing Sheets

TENNIS RACKET

This application is a division of application Ser. No. 218,830, filed July 13, 1988, now abandoned.

BACKGROUND OF THE INVENTION

The present invention relates to tennis rackets and, in particular, to tennis rackets having a flexible section between the head and the handle.

A proper tennis swing requires the player to bring the tennis handle forward and allow its translational kinetic energy to be converted into rotational kinetic energy, that is, angular momentum. This whipping action causes the racket to be snapped about the wrist. A proper swing does not require the player to apply a torque through his wrist around the time of impact. Instead, the conversion of kinetic energy produces the whipping action without much effort at the time of impact.

By contrast, an incorrect swing uses excessive muscle energy at the wrist and elbow to push the racket through the swing. A result of this excessive muscle use is that a bending moment is applied to the shaft of the racket, and possibly causing pain and injury.

Known tennis rackets (U.S. Pat. No. 3,679,205) have employed a shaft that is hinged between the handle and the racket head. This known racket has a detent which causes the racket shaft to fold when an excessive bending moment is applied by a player who improperly swings the racket. The disadvantage with this known racket is the fact that the hinge point is significantly removed from the handle. Thus, the manual sensation caused by the folding of the racket is small.

Furthermore, this racket, once folded, does not return easily to its playing position. Thus, after one bad stroke, the player may not be able to recover. He may not have time to reassemble the racket.

The stiffness of the racket shaft has been unduly emphasized. Existing rackets are made very stiff to compensate for inaccuracies caused by a flexible shaft. As an accelerated racket shaft bends, the accuracy degrades as the angle between the handle and the racket face changes. The conventional approach to guard against these inaccuracies is to make the racket shaft stiffer. Consequently, important considerations such as the feel and biofeedback of a racket are sacrificed in search of greater stiffness.

Accordingly there is a need for a racket that is useful as a training device or a playing device and that has proper biofeedback without adversely affecting the accuracy of the racket.

SUMMARY OF THE INVENTION

In accordance with the illustrative embodiments demonstrating features and advantages of the present invention, there is provided a tennis racket including a head having a face lying in a facial plane. The racket has a shaft affixed to and coplanar with the head. A handle is sized for grasping the racket during play. A flex means is located at least partly within the handle for flexibly coupling the handle to the shaft. The head is relatively displaceable along a direction remaining perpendicular to the facial plane and coplanar with the handle. Thus an incorrect swing of the racket causes flexing at the handle and a manual sensation.

In accordance with an embodiment of the same invention, there is provided a tennis racket having a head and handle as just described. The racket includes a flex means for flexibly coupling the handle to the head to allow relative displacement of the head along a direction that remains perpendicular to the facial plane and to the handle. Thus, the handle remains parallel to the facial plane.

By employing such a racket, an improved playing device is achieved. In one preferred embodiment, the shaft of the racket is riveted to a spaced pair of parallel, flexible boards. These boards extend into the handle of the racket and are affixed to the bottom of the hollow racket handle. Being configured in this way, the shaft is cantilevered by the parallel pair of boards so that it can be displaced. When displaced, however, it remains parallel to the handle. As a result, the handle and the racket head can shift but still remain parallel, to maintain accuracy.

In another preferred embodiment, the racket shaft is pivotally mounted within a hollow handle. A spring or a cantilevered board can urge the shaft to remain parallel to the handle. For example, a flexible board can be affixed to the inner end of the racket shaft and the inner end of the board can be pinned inside a hollow handle. Flexing of the board allows the racket shaft to pivot.

Alternatively, the board can be replaced with a pair of springs that are mounted to the inner end of the pivoted racquet shaft. In this latter embodiment the springs can have their tension adjusted by a threaded support post that can move to change the tension on the springs.

Also, in a constructed embodiment, the pivoted joint between the handle and the racket shaft can be shielded by a thin flexible plate made, for example, of plastic, so that the players are not pinched when the racket shaft pivots.

While the above-mentioned pair of parallel flexible boards may be mounted within the handle, in other embodiments they may be made part of the racket shaft. For example, a pair of parallel boards can have a "Y" shaped configuration. The top of the Y can be riveted or otherwise secured to the perimeter of the racket head; whereas the bottom of the Y can be affixed to the shaft of the racket. Thus the same flexing occurs, with the face of the racket remaining parallel to the racket handle.

BRIEF DESCRIPTION OF THE DRAWINGS

The above brief description as well as other objects features and advantages of the present invention will be more fully appreciated by reference to the following detailed description of presently preferred but nonetheless illustrative embodiments in accordance with the present invention when taken in conjunction with the accompanying drawings wherein.

DETAILED DESCRIPTION OF A PREFERRED EMBODIMENT

Figure 1:
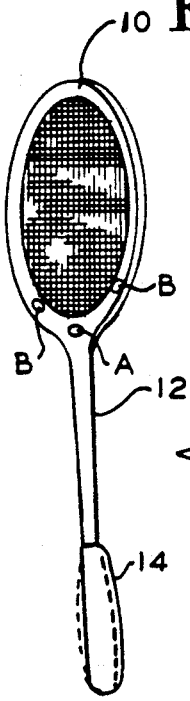
FIG. 1 is a perspective view of a racket in accordance with the principles of the present invention.
Figure 2:
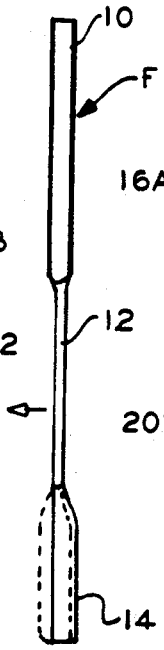
FIG. 2 is a side view of the racket of FIG. 1.

Referring to FIGS. 1 and 2, they show a racket having a head 10, shaft 12, and a handle 14. Handle 14 is shown having a shifted position (the normal position is illustrated in phantom), although the shifting is relative and can be considered a shifting of the head 10 relative to handle 14.

In rackets used for analysis of a player's swing, transducers A and B (FIG. 1) can be embedded in the rim of racket head 10. Not all rackets will employ such transducers. Transducer A is a speed transducer for measuring head speed. Transducer A may employ an accelerometer, but preferably an exposed, heated wire transducer is used. The resistance (and thus the temperature) of this heated wire (not shown) is kept constant by a feedback loop (not shown). The current needed to keep the resistance (and temperature) constant varies with the convection air currents. Since the latter is speed dependent, speed is measured.

Transducers B are mounted on head 10 symmetrically with respect to the axis of shaft 12. Transducers B are accelerometers designed to measure the impulse acceleration caused by impact with the ball. Being mounted on opposite sides, transducers B can detect an offcenter hit, which will tend to twist the racket and cause the transducers B to register differently.

These transducers and those described subsequently may be electrically connected to a data gathering system such as a computer. The kinetic state of the racket may be measured and displayed graphically to determine the quality of the player's swing.

Figure 3A:
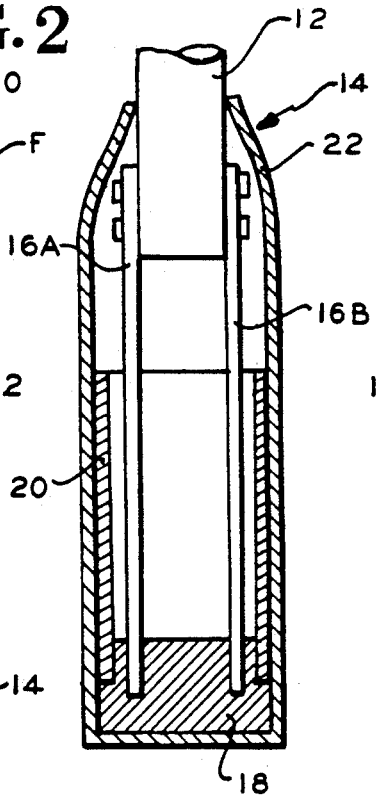
FIG. 3A is a cross-sectional view of the handle of the racket of FIG. 2.

Referring to FIG. 3A, handle 14 is shown in more detail in a cross-sectional view. A resilient or flexible means is shown herein as a pair of cantilevered flexible boards or leaf springs 16A and 16B. Boards 16A and 16B are riveted to the outside of the inner end of shaft 12. The opposite end of boards 16A and 16B are fixed to a base 18 which has slots sized to receive boards 16A and 16B. Base 18 is secured at the distal end of handle 14, and the opposite end of handle 14 is the proximal end thereof. Boards 16A and 16B may be secured to base 18 by epoxy or other fastening means. In a preferred embodiment, boards 16A and 16B may be fiberglass boards about 1" wide, 5" long and ⅛" thick, although other dimensions may be employed, depending upon the desired flexibility and strength. Alternatively, boards 16A and 16B may be formed of a flexible metal that is both light and resilient. It will be appreciated that various materials may be used depending upon the desired strength and flexibility.

Affixed on a shoulder of base 18 is a box-like structure 20 that encircles boards 16A and 16B and gives rigidity to the associated portion of the handle 14. A plastic boot 22 encloses handle 14 to hide boards 16A and 16B. It will be noted that box-like structure 20 does not run the full length of boot 22. Accordingly, there is a more flexible area at the joint between shaft 12 and boards 16A and 16B.

To facilitate an understanding of the principles associated with the foregoing apparatus, the operation of the racket will be described in connection with the foregoing Figures and FIG. 3B. In normal play, the player grasps handle 14. A proper swing requires the player to pull the handle forwardly, allowing the kinetic energy to be converted into angular momentum as the racket snaps through the swing. When the ball (not shown) collides with the racket head 10, a force F (FIG. 2) is applied to head 10. As a result, head 10 shifts relatively to racket 14, as illustrated in FIG. 2.

Figure 3B:
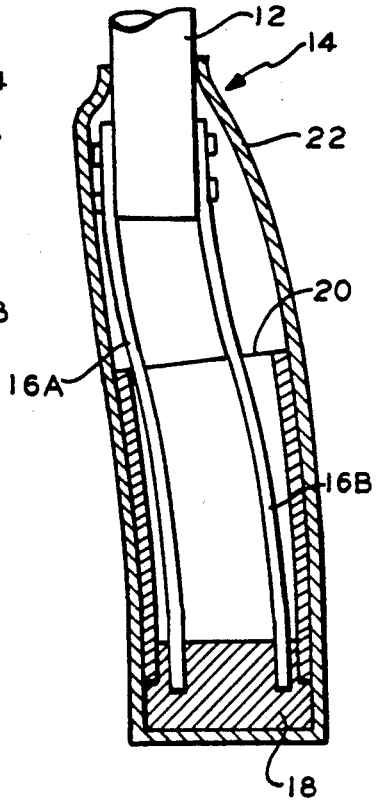
FIG. 3B is a cross-sectional view of the handle of FIG. 3A showing it in a deflected position.

Referring to FIG. 3B, the shifting of shaft 12 with respect to handle 14 is accompanied by the flexing of cantilevered boards 16A and 16B. It will be noted that because of the physical arrangement, shaft 12 remains parallel to handle 14, specifically the rigid box-like structure 20.

When a ball causes deflection, the parallel alignment between the plane of racket head 10 and the axis of handle 14 remains undisturbed. Thus, the ball tends to travel in the direction intended.

The deflection shown in FIG. 38 is excessive and suggests that the player has improperly pushed the racket. It will be noted that boot 22 of handle 14 distorts. The player will notice this distortion which gives him biofeedback on the incorrect nature of his swing. The player not only feels the distortion of boot 22, but the unusual reactive forces associated with the bending of the racket support structure.

Figure 4:
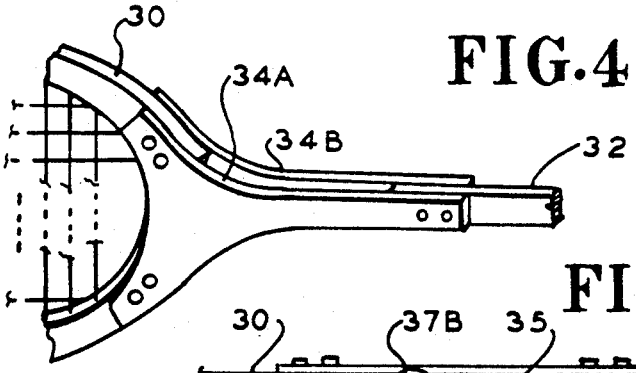
FIG. 4 is a perspective view of a section of a racket having flexible boards which is an alternate to the embodiment of FIG. 1 and is in accordance with the principles of the present invention.

Referring to FIG. 4, it shows a racket head 30 connected to racket shaft 32 by a parallel pair of "Y" shaped boards 34A and 34B. These boards 34A and 34B may be fabricated from a material similar to that of the previously mentioned boards (boards 16A and 168 of FIG. 3A).

Boards 34A and 34B again provide a parallel, cantilevered arrangement. Consequently, the force of a ball or excessive force applied by a player may deflect boards 34A and 34B, but without disturbing the parallel relationship between racket head 30 and shaft 32.

Figure 5A:
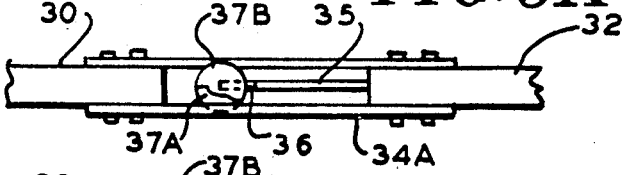
FIG. 5A is a side view of the racket of FIG. 4.
Figure 5B:
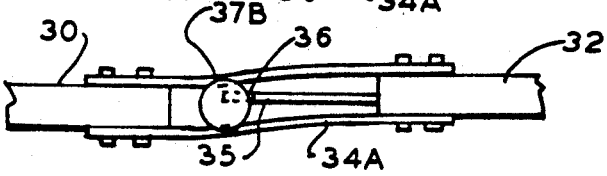
FIG. 5B is a side view showing the racket of FIG. 5B in a deflected position.

Referring specifically to FIGS. 5A and 5B, deflecting boards 34A and 34B change from a flat to a curved condition, shown here as an "S" shaped bend in FIG. 5B. Nevertheless, head 30 and shaft 32 remain parallel.

Deflection is measured by Hall-effect crystal 36 mounted on post 35. A static magnetic field is provided to crystal 36 by permanent magnets 37A and 37B mounted on the outside of boards 34A and 34B, respectively. Magnets 37A and 37B are poled to oppose each other so that the minimum flux crosses crystal 36 when it is centered. Using these transducers, one can determine if a player is using excessive torque to propel the racket. It is the attempt to push the racket from the elbow or turn it with the wrist that causes excessive torque, increases the tension on lesser muscles and increases the likelihood of personal injury. Moreover using the lesser muscles to whip the racket reduces the momentum of the racket. The ability to measure this torque as a function of time enables an analyst to increase a player's power and reduce a propensity toward tennis elbow.

Figure 6A:
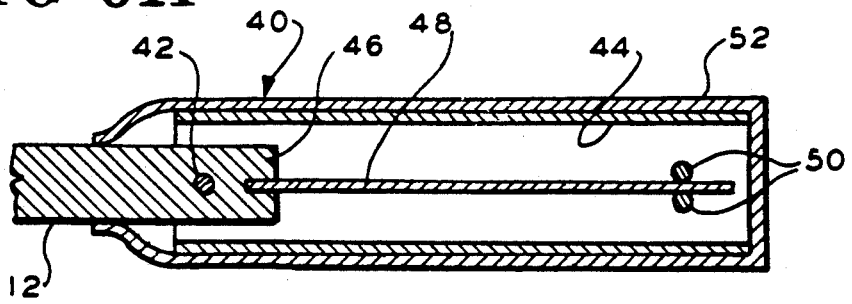
FIG. 6A is a cross-sectional view of a racket handle which is an alternate to that of FIG. 3A.

Referring to FIG. 6A, it shows a handle 40 which is an alternate to that of FIG. 3A. Handle 40 cooperates with the previously described shaft 12. Shaft 12 is mounted on pivot 42, a pin spanning box-like structure 44. Structure 44 and pin 42 are preferably made of steel. The portion of shaft 12 extending within handle 40 beyond pin 42 is referred to as shaft lever 46. Shaft lever 46 is slotted to receive one end of flexible board 48. The other end of flexible board 48 is captured between a pair of restraining pins 50. Pins 50 are staked to opposing sides of structure 44 to restrict the rotational movement of board 48. A plastic boot 52, similar to that previously described, surrounds structure 44 and embraces shaft 12.

Figure 6B:
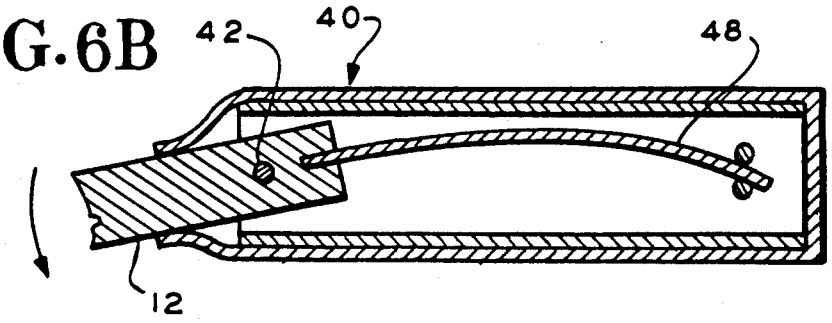
FIG. 6B is a cross-sectional of the handle of FIG. 6A with the racket shaft in a deflected position.

In operation, excessive force applied to the head of a racket or to handle 40 can cause a relative rotation between shaft 12 and handle 40 as shown in FIG. 6B. Such rotation about pivot point 42 causes board 48 to bend as illustrated. As before, the bending gives biofeedback to the player, indicating that he has not swung the racket properly. Because the pivoting occurs at point 42 within the handle, close to the player's hand, the feedback is very strong.

Figure 7:
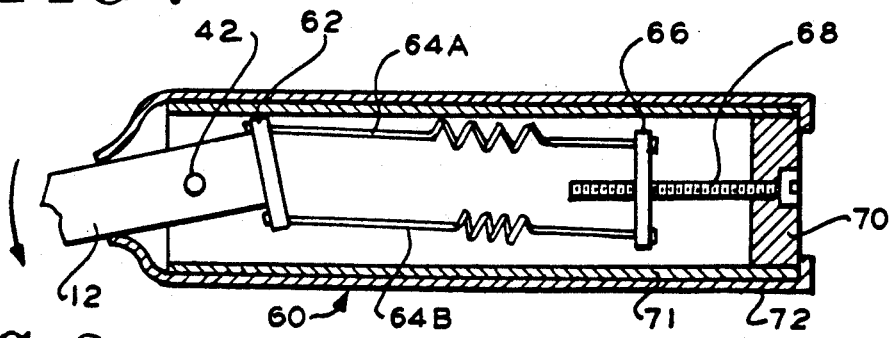
FIG. 7 is a cross-sectional view of a racket handle which is an alternate to that of FIG. 3A.

Referring to FIG. 7, shaft 12 is pivoted on pivot point 42 in a manner similar to that described in connection with FIG. 6A. The inside end of shaft 12 is fitted with a transverse plate 62 which is larger than the width of shaft 12. Affixed to the outer edges of plate 62 are a spaced pair of stretchable elements, shown herein as tension springs 64A and 64B. The outer ends of springs 64A and 64B are affixed to a plate 66 which is threaded onto threaded post 68. Post 68 is rotatably mounted in end base 70. Turning the head of post 68 can move plate 66 in or out, so that the tension on springs 64A and 64B can be adjusted.

A box-like structure 71 encircles end base 70 and gives rigidity to handle 60. Boot 72 encircles structure 71 and provides a covering similar to that described for the other embodiments.

Figure 8:
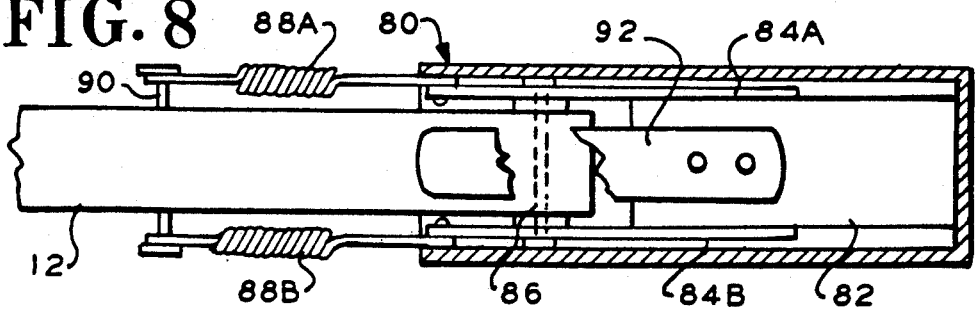
FIG. 8 is a cross-sectional view of a racket handle which is an alternate to that of FIG. 3A.

Referring to FIG. 8, handle 80 has a box-like structure 82 on which are mounted an opposing pair of handle levers 84A and 84B. Levers 84A and 84B may be riveted, welded or otherwise secured to structure 82. Levers 84A and 84B extend beyond structure 82 and have mounted between them pin 86 which acts as a pivot point for racket shaft 12. Levers 84A and 84B extend beyond pivot pin 86 and have respective ends attached to tension springs 88A and 88B. The outer end of springs 88A and 88B are secured to pin 90 which passes through the center of shaft 12.

Shield 92 is shown secured to structure 82 and covering the joint between structure 82 and shaft 12. Shield 92 prevents a player from pinching his fingers when shaft 12 rotates about pin 86.

The operation of the structure of FIG. 8 is similar to that described in connection with FIG. 7.

It is to be appreciated that various modifications may be implemented with respect to the above described preferred embodiments. For example, the various structures can be formed of steel, other metals, plastics, or composite or laminate structures, depending upon the desired strength, weight, flexibility etc. Also, the dimensions and placement of the various components can be altered depending upon the desired characteristics of the device. While cantilevered beams, tension springs and other resilient means are illustrated, it will be appreciated that other means for urging the handle into alignment with the racket shaft can be employed instead.

Obviously many modifications and variations of the present invention are possible in light of the above teachings. It is therefore to be understood that within the scope of the appended claims, the invention may be practiced otherwise than as specifically described.

What is claimed is:

1. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis; and coupling means for elastically coupling said handle to said second end of said shaft effectively only at a position substantially adjacent to the gripping area of said handle in a substantially non-rotatable manner about said central axis, such that said hitting surface can deflect in a direction substantially transverse thereto, said coupling means including spring board means for always bringing said shaft into effective linear alignment with said handle after a ball has been hit so that said racket can be used for rehitting a ball without manual resetting of said shaft with respect to said handle, said spring board means having one end connected with the second end of said shaft and out of engagement with the handle and an opposite end connected with said handle and out of engagement with the shaft, said spring board means including two spring boards in spaced, substantially parallel relation, each said spring board including one end connected to said handle and an opposite end connected to said second end of said shaft.

2. A sports racket according to claim 1, wherein said handle includes a distal end and a proximal end, said proximal end being closer to said shaft than said distal end, said one end of each said spring board being fixedly connected to said distal end of said handle and said opposite end of each said spring board being fixedly connected to said second end of said shaft, with said spring boards being located at least partly within said handle.

3. A sports racket according to claim 2, wherein said spring boards each have a length such that a mid-point therealong is located within said handle such that maximum pivoting of said handle with respect to said shaft occurs substantially adjacent to the gripping area on the handle and within the handle.

4. A sports racket according to claim 2; wherein said handle is hollow and is open at said proximal end, said handle including base means for closing said distal end, and said one end of each said spring board is fixedly connected to said base means and extends through the opening at said proximal end of said handle.

5. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis;

coupling means for elastically coupling said handle to said second end of said shaft effectively only at a position substantially adjacent to the gripping area of said handle in a substantially non-rotatable manner about said central axis, such that said hitting surface can deflect in a direction substantially transverse thereto, said coupling means including first means for always bringing said shaft into effective linear alignment with said handle after a ball has been hit so that said racket can be used for rehitting a ball without manual resetting of said shaft with respect to said handle, said first means having one end in engagement with the second end of said shaft and out of engagement with the handle and an opposite end in engagement with said handle and out of engagement with the shaft; and transducer means mounted adjacent said coupling means for measuring effective bending of said shaft.

6. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis;

coupling means for elastically coupling said handle to said second end of said shaft effectively only at a position substantially adjacent to the gripping area of said handle in a substantially non-rotatable manner about said central axis, such that said hitting surface can deflect in a direction substantially transverse thereto, said coupling means including first means for always bringing said shaft into effective linear alignment with said handle after a ball has been hit so that said racket can be used for rehitting a ball without manual resetting of said shaft with respect to said handle, said first means having one end in engagement with the second end of said shaft and out of engagement with the handle and an opposite end in engagement with said handle and out of engagement with the shaft; and transducer means mounted on said head for measuring the speed of said head.

7. A sports racket according to claim 6, further including transducer means on opposite sides of said head for detecting twisting of said head caused by impact with a ball.

8. A sports racket comprising:

a head having a hitting surface lying in a facial plane;

a shaft connected to the head, the shaft including a first end connected to the head and a second, opposite end;

a hollow handle having a gripping area for grasping said racket during play, said handle having a central axis;

pivot means for pivotally coupling said handle to said second end of said shaft such that pivoting of the shaft with respect to the handle occurs effectively only substantially adjacent the gripping area of the handle in a substantially non-rotatable manner about said central axis, such that said hitting surface can deflect in a direction substantially transverse thereto; and spring means for biasing said shaft to a position substantially in line with said handle and for always bringing said shaft into effective linear alignment with said handle after a ball has been hit so that said racket can be used for rehitting a ball without manual resetting of said shaft with respect to said handle, said spring means having one end in engagement with the second end of said shaft and out of engagement with the handle and an opposite end in engagement with said handle and out of engagement with the shaft, and said spring means extends at least partially within said handle.

9. A sports racket according to claim 8, wherein said coupling means includes a pivot pin which pivotally couples said handle to said second end of said shaft.

10. A sports racket according to claim 8, further including adjusting means for adjusting the spring force of said spring means on said shaft.

11. A sports racket according to claim 8, further including cover means for covering said handle and said coupling means.

12. A sports racket according to claim 8, wherein the length of said shaft is greater than the length of said handle.

13. A sports racket according to claim 8, further including transducer means mounted adjacent said coupling means for measuring effective bending of said shaft.

14. A sports racket according to claim 8, further including transducer means mounted on said head for measuring the speed of said head.

15. A sports racket according to claim 14, further including transducer means on opposite sides of said head for detecting twisting of said head caused by impact with a ball.

16. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis, said handle including a distal end and a proximal end closer to said shaft than said distal end;

pivot means for pivotally coupling said handle to said second end of said shaft such that pivoting of the shaft with respect to the handle occurs effectively only substantially adjacent the gripping area of the handle in a substantially non-rotatable manner about said central axis, such that said hitting surface can deflect in a direction substantially transverse thereto; and spring means for biasing said shaft to a position substantially in line with said handle and for always bringing said shaft into effective linear alignment with said handle after a ball has been hit so that said racket can be used for rehitting a ball without manual resetting of said shaft with respect to said handle, said spring means having a first end in engagement with and restrained by said second end of said shaft and out of engagement with the handle and a second end in engagement with and restrained by said distal end of said handle and out of engagement with the shaft.

17. A sports racket according to claim 16, wherein said first end of said spring means is fixedly connected with said second end of said shaft, and said distal end of said handle includes two spaced restraining pin means therewithin for receiving said second end of said spring means so as to restrain said second end of said spring means.

18. A sports racket according to claim 16, wherein said spring means includes at least one coil spring connected between the second end of said shaft and the distal end of said handle.

19. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis;

pivot means for pivotally coupling said handle to said second end of said shaft such that pivoting of the shaft with respect to the handle occurs effectively only substantially adjacent the gripping area of the handle in a substantially non-rotatable manner about said central axis, such that said hitting surface can deflect in a direction substantially transverse thereto; and spring board means for biasing said shaft to a position substantially in line with said handle and for always bringing said shaft into effective linear alignment with said handle after a ball has been hit so that said racket can be used for rehitting a ball without manual resetting of said shaft with respect to said handle, said spring board means having one end in engagement with the second end of said shaft and out of engagement with the handle and an opposite end in engagement with said handle and out of engagement with the shaft, and said spring means extends at least partially within said handle.

20. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis, said handle being hollow and having a distal end and a proximal end, said proximal end being closer to said shaft than said distal end and said proximal end being open, and said second end of said shaft extends within said handle through said open proximal end;

pivot means for pivotally coupling said handle to said second end of said shaft such that pivoting of the shaft with respect to the handle occurs effectively only substantially adjacent the gripping area of the handle in a substantially non-rotatable manner about said central axis, such that said hitting surface can deflect in a direction substantially transverse thereto; and spring means for biasing said shaft to a position substantially in line with said handle and for always bringing said shaft into effective linear alignment with said handle after a ball has been hit so that said racket can be used for rehitting a ball without manual resetting of said a shaft with respect to said handle, said spring means having one end in engagement with the second end of said shaft end and out of engagement with the handle and an opposite end in engagement with said handle and out of engagement with the shaft.

21. A sports racket according to claim 20, wherein said spring means includes at least one coil spring connected between the second end of said shaft and the proximal end of said handle.

22. A sports racket according to claim 21, wherein said handle is hollow and said spring means extends within said handle.

23. A sports racket according to claim 21, wherein said handle is hollow and said spring means extends outside of said handle.

24. A sports racket according to claim 20, wherein said spring means includes at least one coil spring, said distal end of said handle includes base means for closing said distal end, and further including adjusting means for adjusting the spring force of said spring means on said shaft, said adjusting means including plate means for connecting said at least one coil spring to the distal end of said handle and bolt means extending through said base means and threadedly engaged with said plate means for moving said plate means toward and away from said base means so as to adjust the spring force of said at least one coil spring.

25. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis; and coupling means for elastically coupling said handle to said second end of said shaft effectively only at a position substantially adjacent to the gripping area of said handle in a substantially non-rotatable manner about said central axis, such that said hitting surface can deflect in a direction substantially transverse thereto, said coupling means including first means for always bringing said shaft into effective linear alignment with said handle after a ball has been hit so that said racket can be used for rehitting a ball without manual resetting of said shaft with respect to said handle, said first means having one end in engagement with the second end of said shaft and out of engagement with the handle and an opposite end in engagement with said handle and out of engagement with the shaft, said first means having said one end fixedly connected with the second end of said shaft and the opposite end thereof slidably connected with said handle.

26. A sports racket comprising:

a head having a hitting surface lying in a facial plane;

a shaft connected to the head, the shaft including a first end connected to the head and a second, opposite end;

a handle having a gripping area for grasping said racket during play, said handle having a central axis; and coupling means for elastically coupling said handle to said second end of said shaft effectively only at a position substantially adjacent to the gripping area of said handle in a substantially non-rotatable manner about said central axis, such that said hitting surface can deflect in a direction substantially transverse thereto, said coupling means including first means for always bringing said shaft into effective linear alignment with said handle after a ball has been hit so that said racket can be used for rehitting a ball without manual resetting of said shaft with respect to said handle, said first means having one end in engagement with the second end of said shaft and out of engagement with the handle and an opposite end in engagement with said handle and out of engagement with the shaft, said first means having said one end slidably connected with the second end of said shaft and the opposite end thereof fixedly connected with said handle.

* * * * *